US005575357A

United States Patent [19]

Spiess

[11] Patent Number: 5,575,357

[45] Date of Patent: Nov. 19, 1996

[54] ENTRAINING APPARATUS FOR ELEVATOR DOORS

[75] Inventor: Peter A. Spiess, Meggen, Switzerland

[73] Assignee: Inventio AG, Hergiswil NW, Switzerland

[21] Appl. No.: 421,398

[22] Filed: Apr. 13, 1995

[30] Foreign Application Priority Data

Apr. 25, 1994 [EP] European Pat. Off. ..... 94106380

[51] Int. Cl.[6] ..... B66B 13/12

[52] U.S. Cl. ..... 187/319; 187/330

[58] Field of Search ..... 187/319, 324, 187/330; 49/120, 122

[56] References Cited

U.S. PATENT DOCUMENTS

| | | | |
|---|---|---|---|
| 1,326,440 | 12/1919 | Chaudoir | 187/330 |
| 3,605,952 | 9/1971 | Lusti | 187/319 |
| 3,783,977 | 1/1974 | Voser | 187/319 |
| 4,108,283 | 8/1978 | Mangel | 187/319 |
| 4,313,525 | 2/1982 | McDonald | 49/120 X |
| 4,947,964 | 8/1990 | Husmann | 187/319 |
| 5,246,089 | 9/1993 | Husmann et al. | 187/319 |

FOREIGN PATENT DOCUMENTS

| | | | |
|---|---|---|---|
| 0164581 | 12/1985 | European Pat. Off. | 187/319 |
| 0332841 | 9/1989 | European Pat. Off. . | |
| 0410774 | 1/1991 | European Pat. Off. . | |

*Primary Examiner*—James W. Keenan
*Attorney, Agent, or Firm*—Howard & Howard Attorneys

[57] ABSTRACT

An entraining apparatus for the coupling, unlatching and entraining of elevator shaft doors includes an entraining parallelogram which is movable laterally and is actuated by a door drive on an elevator car. The entraining parallelogram has two vertically extending entraining members, one entraining member being fixedly connected to a slide member horizontally movable in a guide (9) and pushed into a neutral abutment setting by a compression spring during the elevator travel. An arresting parallelogram includes a movable coulisse and the fixed entraining member coupled to an upper link having a pawl lever with a pawl. Upon arrival at a stopping floor, the entraining apparatus is pushed by a pair of shaft door rollers into a centered position and the left shaft door roller moves the coulisse inwardly to engage the pawl between teeth of a comb on the slide member and arrest the entraining apparatus. During travel of the car, the compression spring pushes the entraining apparatus to the neutral position. An eccentric can be rotated to prevent the coulisse from moving the pawl into the arresting position in order to permit adjustment operations on the door drive.

20 Claims, 3 Drawing Sheets

ENTRAINING APPARATUS FOR ELEVATOR DOORS

BACKGROUND OF THE INVENTION

The present invention relates generally to an apparatus for operating elevator shaft doors and, in particular, to an apparatus for the coupling, unlatching and entraining of elevator shaft doors actuated by the door drive on the elevator car.

Collapsible and splayable entraining member parallelogram linkages are a conventionally used technique in elevators for the coupling, unlatching and entraining of shaft doors. An entraining mechanism based on this principle and an unlatching device connected therewith are shown in the European patent application no. 0 410 774. A parallelogram linkage fastened at the car door is splayed and collapsed in the known In the collapsed state of the above described equipment, the shaft door rollers are not touched during travel of the elevator car past floors. On arrival of the car at a stopping floor, the parallelogram linkage is splayed, the shaft door rollers are urged laterally apart the shaft door is thereby coupled and unlatched for entrainment during opening and closing of the car door.

Equipment of this type basically fulfills its intended purpose. However, the entraining rollers must be arranged in exact vertical alignment at the shaft doors for all floors which requires corresponding adjustment operations during the elevator installation. The lateral spring travel of the cars in high performance elevators, which is grater for the purpose of vibration damping, moreover demands a reduction in the opening speed of the entraining member during the coupling of the car door and the shaft door in order to limit the noise development connected therewith.

SUMMARY OF THE INVENTION

The present invention concerns an entraining apparatus for mounting on an elevator car door and for coupling, unlatching and entraining elevator shaft doors. The entraining apparatus includes a generally vertically extending fixed entraining member and a generally vertically extending movable entraining member, a pair of links having opposite ends pivotally connected to the entraining members, the links and the entraining members forming an entraining parallelogram linkage and an arresting means having a first portion connected to the fixed entraining member and a cooperating second portion. When the entraining parallelogram linkage and the second portion of the arresting means are mounted on a door of an elevator car and the first portion of the arresting means is connected to a car door unlatching mechanism, upon arrival of the elevator car at a floor having a shaft door with rollers, one of the rollers being connected to a shaft door unlatching mechanism, the entraining members move between and engage the rollers and the entraining parallelogram linkage is moved into a centered position. The one roller moves the first portion of the arresting means into engagement with the second portion of the arresting means to arrest further movement of the entraining parallelogram linkage relative to the car door, and the first portion of the arresting means operates the car door unlatching mechanism and moves the one roller to operate the shaft door unlatching mechanism.

The first portion of the arresting means includes an arresting coulisse movably mounted on the fixed entraining member for engagement with the one roller and the second portion of the arresting means includes a female portion and the first portion of the arresting means includes a male portion for engaging the female portion. In one embodiment, the female portion is a comb having teeth, the first portion includes a lever and the male portion is a pawl connected to the lever for engaging a space between adjacent ones of the teeth on the comb. In another embodiment, the female portion is a rod having a spline groove formed therein, the first portion includes a lever and the male portion is a wedge member for frictionally engaging the groove in the rod.

The entraining apparatus can include a guide for mounting on the car door, the guide having a movable slide member wherein the fixed entraining member is connected to the slide member. Alternatively, a generally vertically extending carrier member can be connected to the slide member and pivotally connected to a central portion of each of the links of the entraining parallelogram. Also, a pair of generally vertically extending pendulum mounts each having an upper end for pivotal connection to the car door and a lower end pivotally connected to one of the links can be provided with a generally vertically extending synchronizing member pivotally connected to the pendulum mounts.

It is an object of the present invention to provide entraining equipment which is based on the parallelogram principle and displays self-centering properties.

The advantages of the present invention are that, the time for adjusting operations during the installation of a elevator can be shortened and the assembly operations for the shaft door rollers can be simplified. Those advantages are achieved because the entraining members themselves adapt to lateral deviations of the entraining rollers from the vertical of, for example, one to two centimeters.

A further advantage of the present invention is that the centering can take place before the car enters the door zone. When the car is stopped outside the door zone, for example, as a result of a power failure, and the entraining members are coupled, the doors can nevertheless be opened by use of the normal emergency unlatching procedure.

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
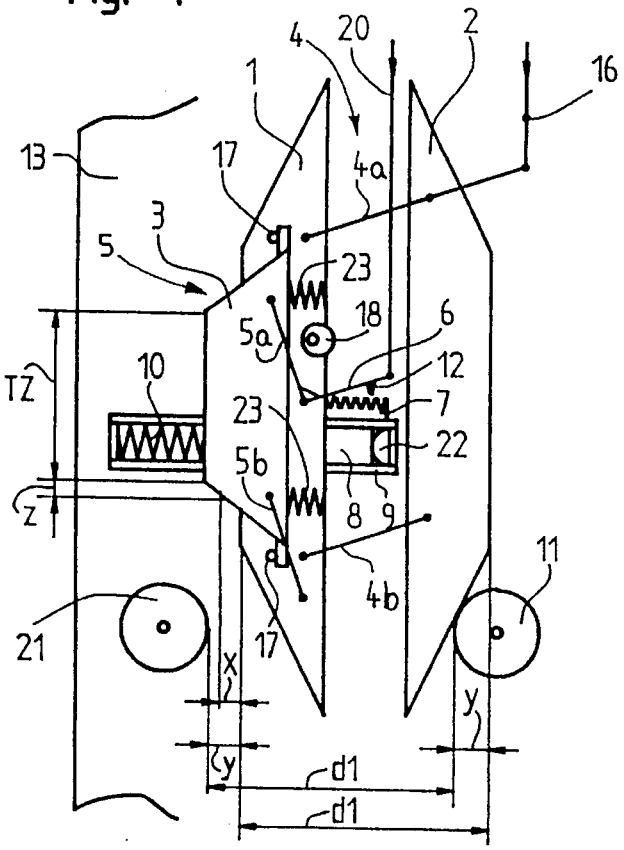
FIG. 1 is a schematic front elevation view of an entraining apparatus for elevator car doors in accordance with the present invention before the beginning of the centering function.

The FIG. 1 shows an entraining apparatus according to the present invention immediately before the beginning of the centering function. The apparatus includes a fixed entraining member I and a movable entraining member 2, each entraining member extending generally vertically and having a ramp surface formed at both upper and lower ends thereof for cooperating with shaft door rollers. The fixed entraining member 1 is connected to a slide member 8 which can be horizontally displaced in a hollow guide 9 closed at both ends. Thus, the fixed entraining member 1 is fixed relative to the slide member 8. The guide 9 is attached to a facing surface of a car door panel 13. A compression spring 10 is positioned inside the guide 9 between a left end of the sliding member 8 and a closed left end of the guide. At a closed right end of the guide 9, there is positioned an elastic abutment 22 which abuts a right end of the slide member 8. The entraining member 1, which is firmly connected with the slide member 8, is retained in the illustrated position by the compression spring 10.

The fixed entraining member 1 and the movable entraining member 2 are articulatedly connected together by a pair of generally horizontally extending links to form an entraining parallelogram linkage 4. The links are an upper link **4*a* and a lower link 4*b* which are pivotally connected to the members 1 and 2. The upper parallelogram link 4*a* is extended outwardly to the right beyond the movable entraining member 2 and is connected at a free end articulatedly with a generally vertically extending rod 16 for the opening and closing of the entraining members. Thus, the movable entraining member 2 is movable relative to both the fixed entraining member 1 and the slide member 8. A generally vertically extending arresting coulisse 3 is mounted on the fixed entraining member 1 by a pair of links for free movement within a defined range. The member 1 and the coulisse 3 are articulatedly connected together by the pair of links to form an arresting parallelogram linkage 5. The links are an upper link 5*a* and a lower link 5*b* pivotally connected to the member 1 and the coulisse 3. The upper parallelogram link 5*a* is extended outwardly to the right to form a lever 6 having a male portion 12 of an arresting device connected to the underside thereof. For example, the lever 6 can be a pawl lever and the male portion 12 can be a downwardly directed pawl. The lever 6 has a free end articulatedly connected with a rod 20 for the unlatching of the car door. During movement of the coulisse 3 to the right and the resultant downward movement of the lever 6, the pawl 12 can engage a female portion 7 of the arresting device attached to the car door panel 13 to arrest further movement of the entraining parallelogram linkage 4. For example, the female portion 7 can be a comb having teeth with the pawl 12 engaging spaces or gaps between adjacent ones of the teeth. The upward movement of the lever 6 and the movement of the arresting coulisse 3 to the left are limited by a pair of abutment pins 17 mounted on the fixed entraining member 1** adjacent upper and lower ends of the coulisse.

An eccentric 18 is mounted at a right edge of the fixed entraining member 1. An arresting of the entraining apparatus is prevented or cancelled by a rotation of the eccentric 18 through 180° from the position shown which engages a right edge of the coulisse 3 to limit movement of the coulisse to the right and the pawl 12 from being moved downwardly to engage gaps between teeth of the comb 7. The arresting coulisse 3 is urged against the abutment pins 17 by a pair of compression springs 23 mounted on the fixed entraining member 1. An outer or left edge of the arresting coulisse 3 has a length denoted TZ which corresponds to the door zone region at the floors served by the elevator car. In the illustrated opened state of the entraining members 1 and 2, the distance from an outer or left edge of the member 1 to an outer or right edge of the member 2 is denoted as d1. The internal dimension between a fixed shaft door roller 11 and a movable shaft door roller 21 is also the distance d1. The necessary displacement travel of the entraining apparatus to complete centering is denoted by y. The necessary splaying travel of the movable shaft door roller 21 to the point of unlatching of the shaft door is denoted by x. The unlatching of the shaft door takes place in a region of length z of the lower ramp surface of the arresting coulisse 3 after this lower ramp surface has been urged to the right by the shaft door roller 21 and until the arresting of the entraining apparatus.

Figure 2:
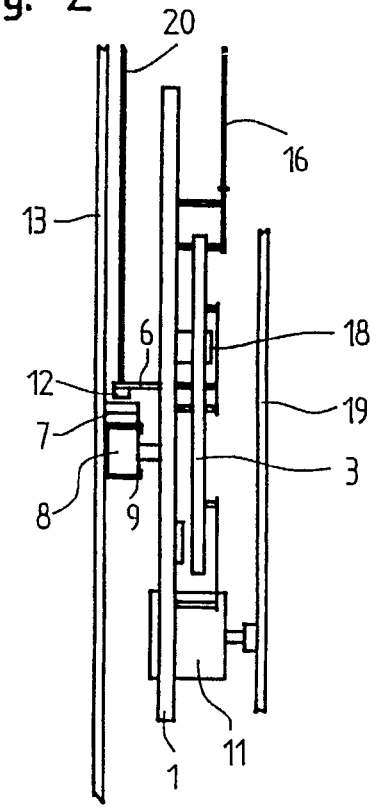
FIG. 2 is a schematic side view of the apparatus shown in the FIG. 1.

In the FIG. 2, the position of the slide member 8 in the guide 9 is evident as well as are the shapes of the guide and the pawl 12. Furthermore, a part of a shaft door 19 as well as the fixed shaft door roller 11 are illustrated.

Figure 3:
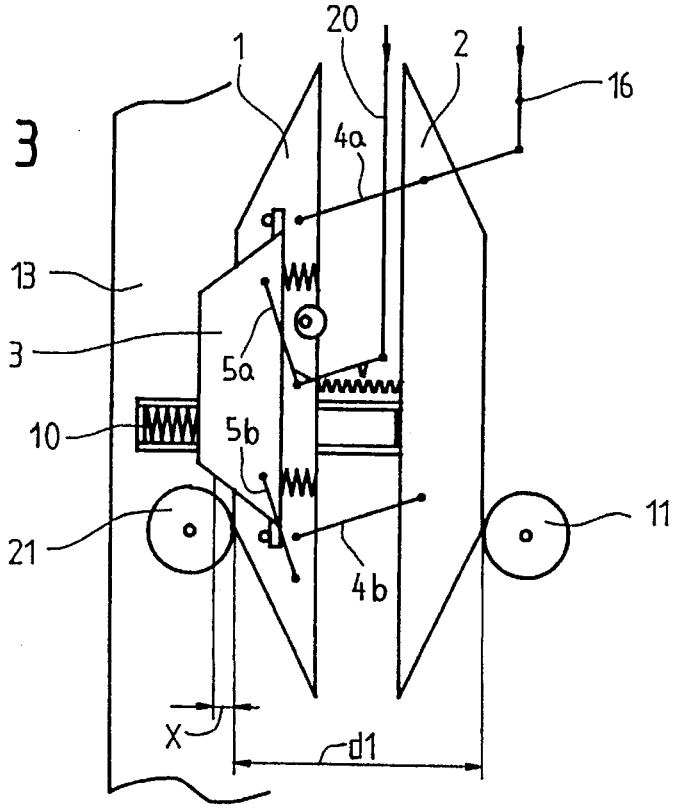
FIG. 3 is a schematic front elevation view of the entraining apparatus shown in the FIG. 1 after the centering function has taken place.

In the FIG. 3, the elevator car and the door entraining apparatus have moved downwardly and the apparatus is situated between the shaft door rollers 11 and 21 and centered thereby. The centering has caused both entraining members 1 and 2 to be displaced to the left by the distance y against the restoring force of the compression spring 10 which has been compressed by the same amount y.

Figure 4:
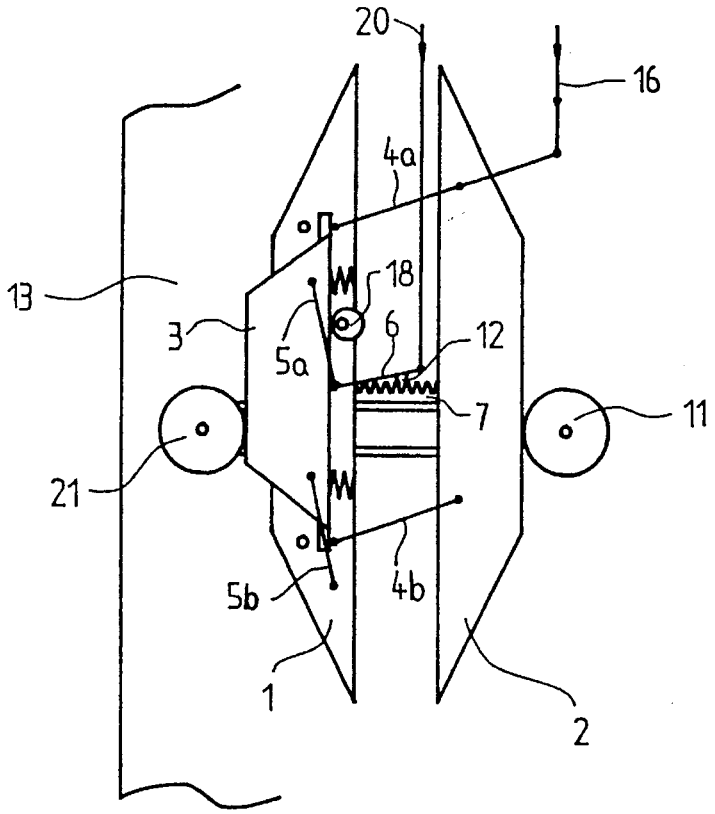
FIG. 4 is a schematic front elevation view of the entraining apparatus shown in the FIG. 1 after the arresting and unlatching of the shaft door and the car door have taken place.

In the FIG. 4, the elevator car and the door entraining apparatus have been moved further downwardly between the rollers 11 and 21 and are situated at the floor level. The movable shaft door roller 21 has run up onto the right edge of the arresting coulisse 3 and has initially urged the coulisse inwardly, or to the right, until engagement between the pawl 12 and a gap between teeth on the comb 7 arrested movement. Also, movement of the coulisse 3 to the right has unlatched the car door 19 by way of the link **5*a*, the pawl lever 6 and the rod 20. Furthermore, the movable shaft door roller 21 was pushed to the left by the distance x when the coulisse 3 became stationary which unlatched the shaft door 19**.

Figure 5:
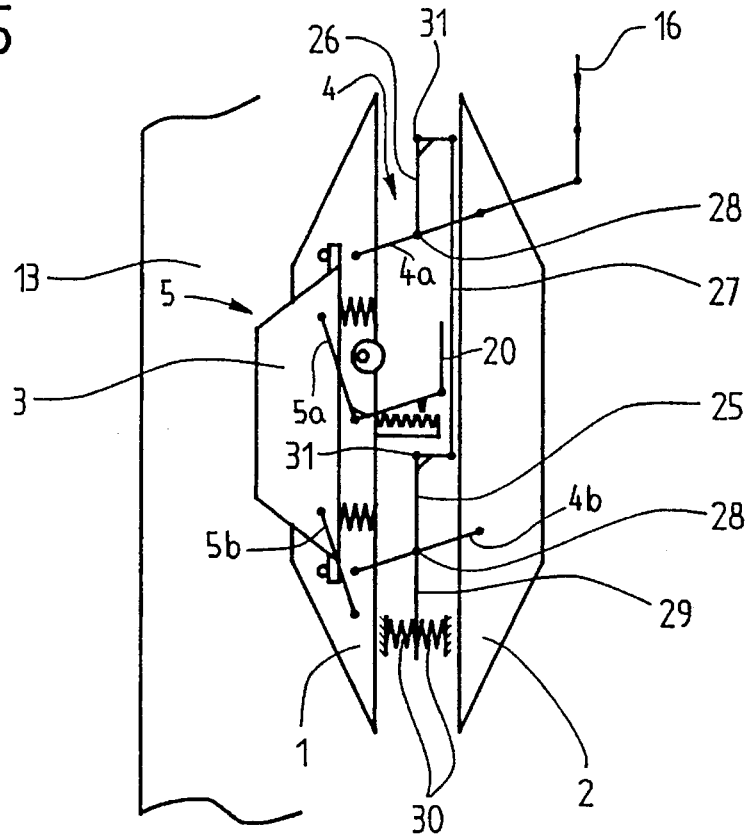
FIG. 5 is a schematic front elevation view of an alternate embodiment of the apparatus shown in the FIG. 1; and The FIG. 6 is an enlarged schematic side view of an alternate embodiment arresting device.

In the FIG. 5 there is shown an alternate embodiment of the entrainment apparatus according to the present invention in which the centering displacement of the entraining members is made possible by a pendulum mounting of the same. The entraining parallelogram linkage 4 is connected at a center portion of each of the parallelogram links **4*b* and 4*a*, at an associated one of a pair of suspension pivot points 28, with lower ends of a pair of pendulum mounts 25 and 26 respectively. The pendulum mounts 25 and 26 are each connected at an upper end to the car door panel 13 at an associated one of a pair of pivot points 31. The pendulum mounts 25 and 26 each extend generally horizontally from the upper ends at the pivot points 31 to free ends which are connected together by a synchronizing rod 27 for the purpose of constrained parallel lateral movement during the centering operation. A downwardly directed mount extension 29 from the lower end of the pendulum mount 25 at the pivot point 28 is guided between a pair of compression springs 30 which hold the entraining parallelogram linkage 4 in a neutral middle position. During the coupling with the shaft door 19, the springs 30 enable a self-centering outward pivoting of the entraining apparatus. The functions of arresting of the entraining apparatus and the unlatching of the car door panel 13 and the shaft door 19** are the same as described above.

The individual functions of the entraining apparatus according to the present invention are as follows:

The eccentric 18 functions to provide adjusting operations at the car door drive when the elevator is installed. Through rotation of the eccentric 18 by 180°, the full movement of the coulisse 3 to the right and the arresting of the arresting parallelogram linkage 5 is prevented, and the car door 13 remains unlatched. The rotated eccentric 18 prevents movement of the coulisse 3 to the right through the distance x thereby preventing engagement between the pawl 12 and the comb 7 and movement of the rod 20.

Upon departure of the elevator car from the stopping floor, the entraining parallelogram linkage 4 of the entraining apparatus is collapsed by the door drive through drawing the rod 16 upwardly and its arresting is thereby released through raising of the pawl 12 so that the entraining apparatus again becomes free and is pushed into the neutral initial setting by means of the compression spring 10. On the collapse of the entraining parallelogram linkage 4, the shaft door roller 21 is also pivoted into the original position and has latched the shaft door 19 by way of an appropriate mechanism (not shown). With the entraining parallelogram linkage 4 collapsed, the floors for which no stop command exists are travelled through without the entraining apparatus touching the shaft door rollers 11 and 21 if the deviation of the shaft door rollers 11 from a vertically extending target line does not exceed the play between the external outline of the entraining members 1 and 2 and the shaft door rollers 11 and 21.

It is desirable that the self-centering displacement of the entraining members 1 and 2 takes place with as little friction as possible. For this purpose, the slide member 8 can supported in the guide 9 by linear rolling bearings and be of an appropriate length so that the turning moment forces can be absorbed and the play in the entire entraining system remains as small as possible. The teeth of the comb 7 are preferably constructed with opposed sides that taper inwardly and upwardly and the pawl 12 is likewise constructed with corresponding sides that taper inwardly and downwardly in order that the shape of the pawl complements the shape of the gaps between teeth to prevent interference problems during the coupling-in.

Figure 6:
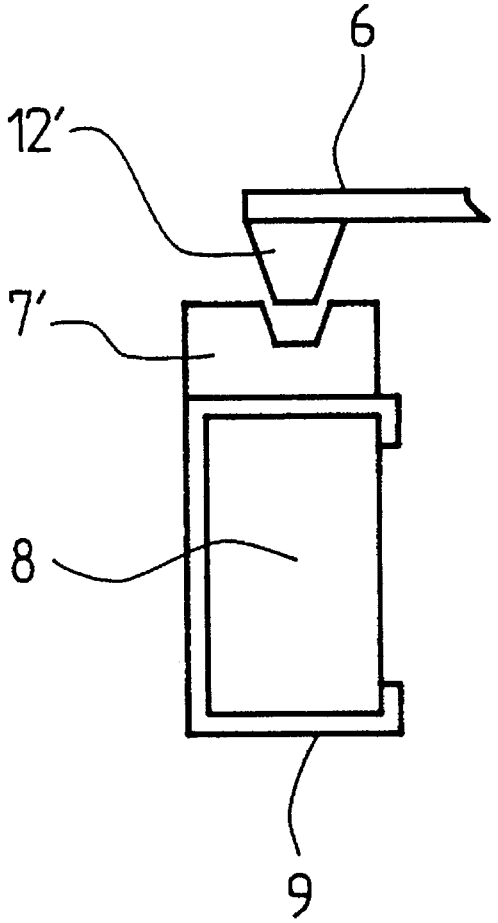

As a variation, the arresting of the entraining members can be accomplished by a frictional locking between the male portion 12' which is formed as a wedge member and the female portion 7' which is formed as rod having a longitudinal spline groove formed therein as shown in the FIG. 6. The wedge member 12' is urged by the arresting coulisse 3 and the upper parallelogram arm 5*a* into the groove on the rod 7' during travel into the stopping floor and the entraining apparatus is thus arrested in the centered position.

The entraining apparatus can also be constructed as a symmetrically operating parallelogram linkage. Then, the entraining members 1 and 2 move around pivot points which are situated in the center of the parallelogram links, wherein these pivot points are connected to the slide member 8 by a vertically extending carrier member. As shown in the FIG. 5, if the pendulum mounts 25 and 26, the extension 29 and the springs 30 are eliminated, the pivot points can be the pivot points 28 and the carrier member can be the rod 27 with opposite ends thereof connected to the links 4*a* and 4*b* at the pivot points 28.

Furthermore, the resetting of the entraining apparatus into a neutral middle or abutment setting during travel can also take place through appropriately arranged tension springs in place of the compression spring 10.

For the purpose of noise suppression during the centering operation, the ramps of the entraining members 1 and 2 are each provided with a respective elastic soft cover or coating. However, the vertically extending edges of the entraining members is constructed to be hard and capable of support. The entraining member bodies can be constructed of any desired lightweight constructional material in order to keep the mass to be displaced during centering as small as possible.

In the case of the alternate embodiment shown in the FIG. 5, the restoring springs 30 can be replaced, for example, by a light hydraulic or pneumatic shock absorber. A restoration of the entraining apparatus into an initial position would take place solely due to gravity.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. An apparatus for mounting on an elevator car door and for coupling, unlatching and entraining elevator shaft doors comprising:

a generally vertically extending fixed entraining member and a generally vertically extending movable entraining member;

a pair of links having opposite ends pivotally connected to said entraining members, said links and said entraining members forming an entraining parallelogram linkage permitting movement of said movable entraining member relative to said fixed entraining member; and an arresting means having a first portion connected to said fixed entraining member and a cooperating second portion whereby when said entraining parallelogram linkage and said second portion of said arresting means are mounted on a door of an elevator car and said first portion of said arresting means is connected to a car door unlatching mechanism, upon arrival of the elevator car at a floor having a shaft door with rollers, one of the rollers being connected to a shaft door unlatching mechanism, said entraining members move between and engage the rollers and said entraining parallelogram linkage is moved into a centered position, the one roller moves said first portion of said arresting means into engagement with said second portion of said arresting means to arrest further movement of said entraining parallelogram linkage relative to the car door, and said first portion of said arresting means operates the car door unlatching mechanism and moves the one roller to operate the shaft door unlatching mechanism.

2. The apparatus according to claim 1 wherein said first portion of said arresting means includes an arresting coulisse movably mounted on said fixed entraining member for engagement with the one roller.

3. The apparatus according to claim 1 wherein said second portion of said arresting means includes a female portion and said first portion of said arresting means includes a male portion for engaging said female portion.

4. The apparatus according to claim 3 wherein said female portion is a comb having teeth, said first portion includes a lever and said male portion is a pawl connected to said lever for engaging a space between adjacent ones of said teeth on said comb.

5. The apparatus according to claim 3 wherein said female portion is a rod having a spline groove formed therein, said first portion includes a lever and said male portion is a wedge member for frictionally engaging said groove in said rod.

6. The apparatus according to claim 1 including a guide for mounting on the car door, said guide having a movable slide member and wherein said fixed entraining member is connected to said slide member.

7. The apparatus according to claim 1 including a guide for mounting on the car door, said guide having a movable slide member, and a generally vertically extending carrier member connected to said slide member, said carrier member being pivotally connected to a central portion of each of said links.

8. The apparatus according to claim 1 including a pair of generally vertically extending pendulum mounts each having an upper end for pivotal connection to the car door and a lower end, each of said links having a central portion pivotally connected to said lower end of an associated one of said pendulum mounts, and a generally vertically extending synchronizing member pivotally connected to said pendulum mounts.

9. The apparatus according to claim 1 including at least one compression spring coupled to said entraining members for forcing said entraining parallelogram linkage into a neutral position during travel of the elevator car between floors.

10. The apparatus according to claim 1 wherein said links each have a central portion for pivotally mounting on the car door and when said links are pivotally mounted on the car door, said entraining parallelogram linkage is moved into a neutral position by gravity during travel of the elevator car between floors.

11. The apparatus according to claim 1 wherein opposite outer edges of said entraining members are spaced apart a predetermined distance corresponding to a distance by which the shaft door rollers are spaced apart when the shaft door is latched.

12. The apparatus according to claim 1 including an eccentric mounted on said fixed entraining member, said eccentric being manually actuatable for preventing said first portion of said arresting means from engaging said second portion of said arresting means thereby preventing arresting of movement of said entraining parallelogram linkage relative to the car door.

13. An apparatus for mounting on an elevator car door and for coupling, unlatching and entraining elevator shaft doors comprising:

a generally vertically extending fixed entraining member and a generally vertically extending movable entraining member;

a pair of first links having opposite ends pivotally connected to said entraining members, said first links and said entraining members forming an entraining parallelogram linkage permitting movement of said movable entraining member relative to said fixed entraining member;

an arresting coulisse;

a pair of second links having opposite ends pivotally connected to said arresting coulisse and said fixed entraining member, said second links, said arresting coulisse and said fixed entraining member forming an arresting parallelogram linkage; and an arresting means having a first portion connected to said arresting coulisse and a cooperating second portion whereby when said entraining parallelogram linkage, said arresting parallelogram linkage and said second portion of said arresting means are mounted on a door of an elevator car and said first portion of said arresting means is connected to a car door unlatching mechanism, upon arrival of the elevator car at a floor having a shaft door with rollers, one of the rollers being connected to a shaft door unlatching mechanism, said entraining members move between and engage the rollers and said entraining parallelogram linkage is moved into a centered position, the one roller engages said arresting coulisse and moves said first portion of said arresting means into engagement with said second portion of said arresting means to arrest further movement of said entraining parallelogram linkage relative to the car door, said first portion of said arresting means operates the car door unlatching mechanism and said arresting coulisse moves the one roller to operate the shaft door unlatching mechanism.

14. The apparatus according to claim 13 wherein said second portion of said arresting means includes a female portion and said first portion of said arresting means includes a male portion for engaging said female portion.

15. The apparatus according to claim 13 including a guide for mounting on the car door, said guide having a movable slide member and wherein said fixed entraining member is connected to said slide member.

16. The apparatus according to claim 13 including a guide for mounting on the car door, said guide having a movable slide member, and a generally vertically extending carrier member connected to said slide member, said carrier member being pivotally connected to a central portion of each of said first links.

17. The apparatus according to claim 13 including a pair of generally vertically extending pendulum mounts each having an upper end for pivotal connection to the car door and a lower end, each of said first links having a central portion pivotally connected to said lower end of an associated one of said pendulum mounts, and a generally vertically extending synchronizing member pivotally connected to said pendulum mounts.

18. An apparatus for mounting on an elevator car door and for coupling, unlatching and entraining elevator shaft doors comprising:

a pair of generally vertically extending entraining members;

a pair of first links having opposite ends pivotally connected to said entraining members, said first links and said entraining members forming an entraining parallelogram linkage permitting movement of said movable entraining member relative to said fixed entraining member;

an arresting coulisse;

a pair of second links having opposite ends pivotally connected to said arresting coulisse and one of said entraining members, said second links, said arresting coulisse and said one entraining member forming an arresting parallelogram linkage;

a pawl attached to one of said second links; and a comb having teeth whereby when said entraining parallelogram linkage and said comb are mounted on a door of an elevator car and said one second link is connected to a car door unlatching mechanism, upon arrival of the elevator car at a floor having a shaft door with rollers, one of the rollers being connected to a shaft door unlatching mechanism, said entraining members move between and engage the rollers and said entraining parallelogram linkage is moved into a centered position, the one roller engages said arresting coulisse and moves said pawl into engagement with a space between adjacent ones of said teeth to arrest further movement of said entraining parallelogram linkage relative to the car door, said one second link operates the car door unlatching mechanism and said arresting coulisse moves the one roller to operate the shaft door unlatching mechanism.

19. The apparatus according to claim 18 including a guide for mounting on the car door, said guide having a movable slide member and wherein said one entraining member is connected to said slide member.

20. The apparatus according to claim 18 wherein said first links are each pivotally connected to a generally vertically extending synchronizing member at a central portion of said first links.

* * * * *